United States Patent [19]

LaMarche

[11] 3,980,375

[45] Sept. 14, 1976

[54] CONNECTOR FOR FLEXIBLE CIRCUITRY

[75] Inventor: Frederick W. LaMarche, Northfield, Minn.

[73] Assignee: Sheldahl, Inc., Northfield, Minn.

[22] Filed: Nov. 10, 1975

[21] Appl. No.: 630,088

[52] U.S. Cl. ..... 339/61 M; 339/255 P

[51] Int. Cl.[2] ..... H01R 9/12

[58] Field of Search ..... 339/59–61, 339/174, 175, 255, 261

[56] References Cited

UNITED STATES PATENTS

| | | | |
|---|---|---|---|
| 2,248,718 | 7/1941 | Owen | 339/61 R |
| 3,582,863 | 6/1971 | Hoffman | 339/59 M |
| 3,820,054 | 6/1974 | Clewes et al. | 339/61 M |

*Primary Examiner*—Joseph H. McGlynn
*Attorney, Agent, or Firm*—Orrin M. Haugen

[57] ABSTRACT

A connector for flexible printed circuitry including an elongated rectangular resilient receptacle having a plurality of rigid contact pins disclosed within the resilient block, and extending generally laterally outwardly thereof. The resilient block has an opening formed therein, with the opening extending across a pair of opposed spaced apart jaw members, with the opening including a diagonally extending throat zone which is in communication with a central cavity, the central cavity being disposed between the jaw members, and with the throat zone being disposed between inner and outer lip surfaces. The inner lip surface joins the central cavity along a generally convex surface, with the surface of each of said rigid pin members being substantially tangential through a convex surface, the arrangement being such that the rigid pin members maintain the convex juncture surface in flexed disposition away from said cavity to normally bias said convex surface against the surfaces of said rigid pin members.

2 Claims, 6 Drawing Figures

CONNECTOR FOR FLEXIBLE CIRCUITRY

BACKGROUND OF THE INVENTION

The present invention relates generally to an improved connector for flexible circuitry, and more specifically to a connector device for flexible circuitry which provides a terminal block for such circuitry. More specifically, the present invention relates to a connector for flexible circuitry devices which includes a generally resilient body member having a cavity formed therein, and utilizing a plurality of rigid contact pins which maintain a portion of the resilient body member in pre-stressed disposition so as to obtain a constant contact force between conductor ribbons and the rigid contact pins.

In the past, connectors for flexible circuitry, specifically flexible printed circuitry have been available, however the connector devices frequently are provided with mechanical means or the like to provide a normal bias or contact force between the individual conductors and the contact pins. The structure of the present invention utilizes a construction which intentionally deforms the resilient connector body, and the deforming of the body functions to provide the mechanical bias necessary to retain and maintain contact between the surfaces of the conductors on the flexible circuitry, and the surfaces of the rigid contact pins.

Briefly, in accordance with the present invention, a connector means for electrical circuitry, specifically flexible printed circuitry is provided, with the connector means comprised in a resilient block having an opening formed therein and extending across a pair of opposed spaced apart jaws. Rigid contact pins extend inwardly of the resilient block and are disposed generally transversely to the longitudinal axis of the block. The rigid contact pins are disposed so as to cause flexure of the opposed jaw members, with the flexure providing mechanical bias for maintaining surface contact and results in electrical contact between the individual conductor ribbons on the flexible circuitry, and the rigid contact pins forming a portion of the connector.

The structure of the present invention is simple and straightforward, and nevertheless provides mechanical stability and electrical continuity on an extremely reliable basis.

SUMMARY OF THE INVENTION

Therefore, it is a primary object of the present invention to provide an improved electrical connector means particularly adapted for a terminal or interconnect with flexible electrical circuitry, specifically circuitry disposed upon a flexible insulative substrate.

It is a further object of the present invention to provide an improved connector means for flexible electrical circuitry, with the connector means employing a resilient block having a plurality of rigid contact pins extending inwardly thereof, and with the contact pins being arranged to cause flexure of the resilient block, the flexure being, in turn, utilized to provide the mechanical bias necessary to maintain mechanical stability and electrical continuity.

It is yet a further object of the present invention to provide an improved reliable connector means for flexible electrical circuitry wherein the resilient block means has an opening formed therein, and has a plurality of rigid contact pins extending inwardly thereof, the contact pins passing through the opening formed within the resilient block to receive the flexible electrical circuitry, and with the rigid contact pins deforming the normal configuration of the resilient block so as to obtain the bias force necessary for mechanical stability and electrical continuity.

Other and further objects of the present invention will become apparent to those skilled in the art upon a study of the following specification and appended claims, along with the accompanying drawing.

DESCRIPTION OF THE PREFERRED EMBODIMENT

Figure 1:
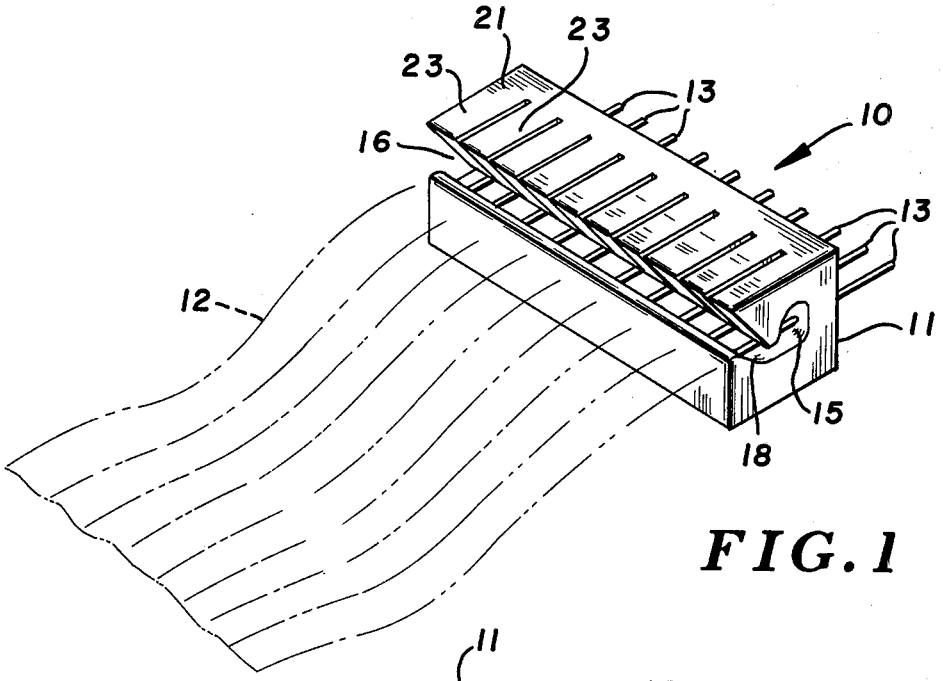
FIG. 1 is a perspective view of the electrical connector means of the present invention, and illustrating a segment of a typical flexible electrical circuit element arranged in operative relationship with the connector means.
Figure 2:
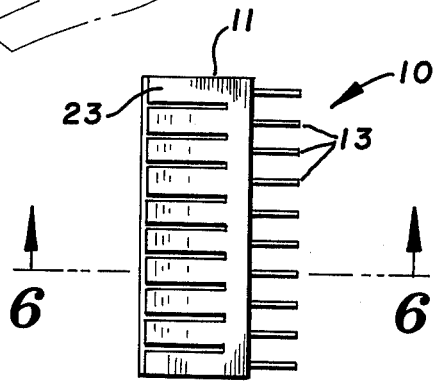
FIG. 2 is a top plan view of the electrical connector means illustrated in FIG. 1.
Figure 3:
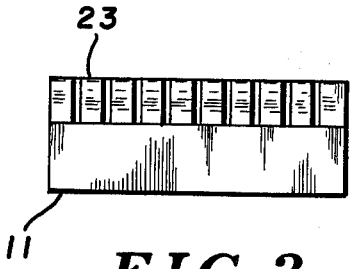
FIG. 3 is a front elevational view of the connector means illustrated in FIG. 1.
Figure 4:
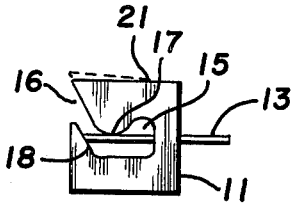
FIG. 4 is a side elevational view of the connector means illustrated in FIG. 1, and showing the normal flexed disposition of the body of the connector means as a result of the location of the rigid contact pins.
Figure 5:
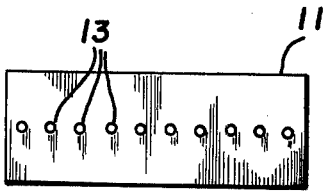
FIG. 5 is a rear elevational view of the connector means of FIG. 1.

In accordance with the preferred embodiment of the present invention, and with particular attention being directed to FIG. 1 of the drawing, the electrical connector means generally designated 10 includes a resilient block or body member 11 having a flexible electrical circuitry element generally designated 12 coupled thereto. The pattern of the circuitry disposed on the surface of the substrate forming the flexible circuit element 12 is disposed such that the terminal portions adjacent to and in contact with the connector means 10 are spaced apart on a regular basis so as to provide a contacting surface with the pin elements 13—13 of connector means 10. Such flexible electrical circuitry is well known in the art, and does not form any portion of the present invention, except that such circuitry is peculiarly adapted for use in connection with the connector means of the present invention.

Figure 6:
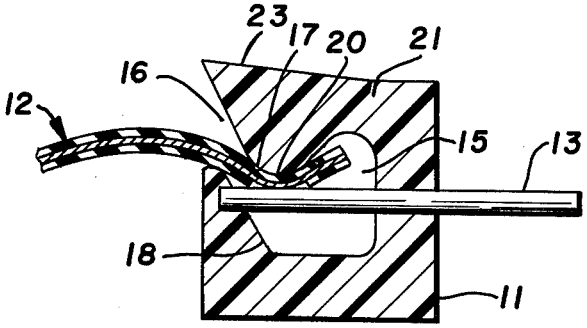
FIG. 6 is a vertical sectional view taken along the line and in the direction of the arrows 6—6 of FIG. 2, with FIG. 6 being shown on a slightly enlarged scale.

As has been indicated, resilient block 11 is provided with a plurality of individual rigid contact pins 13—13, with the pins extending generally through the resilient block 11, as illustrated in detail in FIG. 6. As will become apparent hereinafter, the location and disposition of pins 13—13 provide a means for achieving mechanical stability and electrical continuity between the individual conductors disposed on the surface of flexible circuitry element 12 and rigid contact pins 13—13.

With the attention now being directed to FIGS. 1 and 6 of the drawing, resilient block 11 has an opening or cavity formed in the interior thereof as at 15, with the throat zone 16 extending from the surface of the resilient block generally diagonally inwardly to a point of communication with the central cavity 15. Cavity 15 along with throat zone 16 provide a pair of jaws as at 17 and 18, with the jaws 17 and 18 being normally retained in a spaced apart opposed relationship. Thus, the resilient block 11 has a longitudinal axis with the jaw members being generally parallel to the longitudinal axis of the block, and with the rigid contact pins being disposed generally transversely of the longitudinal axis and accordingly along the transverse axis of the block.

As has been indicated, the disposition of the rigid contact pins 13—13 is such that at least one of the jaw members is flexed away from its normal disposition, and with this flexure normally biasing the jaw against the surface of the rigid contact pin. In order to accommodate or receive the flexible electrical circuitry within the connector means, it will be observed in FIGS. 1 and 6 that the circuitry 12 enters the resilient block 11 through the throat zone 16, and extends inwardly to the central cavity 15. At the juncture point or meeting point of the throat zone 16 and the central cavity 15, there is a generally convex surface such as at 20 which is normally biased, due to flexure of the resilient means, against the surface of the rigid contact pins 13—13. In this connection, the flexural point or hinge zone is shown generally at 21. In its flexed or prestressed position, the convex surface is arranged with the surfaces of each of the rigid contact pins being substantially tangential to the convex surface. This feature is illustrated in detail in FIG. 6. In their normal fixed dispositions, the rigid contact pins extend or span the central cavity 15, and are secured or otherwise received within the outer lip 18. This physical arrangement is a means of generating a constant force to exist between the surface of the inner lip 17, such as that in the convex juncture point 20 and the surface of the rigid contact pin.

In a connector means fabricated in accordance with the present invention, it is possible to have the resilient block means 11 fabricated as a generally solid structure, with the exception of the central cavity 15 and the throat zone 16. However, for purposes of accommodating mechanical and electrical tolerances, it is frequently desirable to provide a number of slats such as at 23—23 in the resilient block along and adjacent the inner lip zone 17. These slats preserve the stability of the hinge zone at 21, but provide for accommodation of varying thicknesses or other anomalies which may occur in either the flexible circuitry 12 or the resilient block 11.

While the connector means of the present invention has been illustrated as a terminal block which provides a means of coupling conventional conductors by means of wire-wrap or the like to rigid pins such as the pins 13—13, it will be appreciated that the connector means of the present invention may provide an inner face organ or connecting elements between a pair of flexible electrical circuitry elements such as two elements of the type shown at 12—12. In such an arrangement, therefore, the block 11 would be modified so as to have a pair of opposed assemblies in back-to-back relationship, with each assembly being designed to receive its own flexible circuitry element therewithin.

The materials of construction to be utilized in the connector means in the present invention are deemed conventional. For example, resilient blocks fabricated from molded Teflon (polytetrafluoroethylene), vinyl materials, polyethylene, polypropylene, nylon, or other generally resilient material having good electrical properties. In addition, rubber such as, for example, silicone rubber may be employed. The pins 13—13 are preferably fabricated from a generally rigid material such as, for example, steel wire or the like. They may be either in cylindrical form, or may have protruding or laterally extending portions provided with flat surfaces for receiving conventional wire-wraps.

I claim:

1. Connector means for electrical circuitry disposed upon a flexible substrate and forming a flexible circuitry assembly, said connector means comprising:

a. a resilient block means with a longitudinal axis and having an opening formed therein and extending across a pair of opposed spaced apart jaw members, with the elongated axis of said jaw members being generally parallel to said longitudinal axis, and with said opening having a throat zone extending generally diagonally inwardly from the surface of said resilient block, and being in communication with a central cavity disposed between said jaw members, said throat zone being disposed between the surfaces of an inner lip and an outer lip element;

b. rigid contact pins extending inwardly of said resilient block and being disposed generally transversely of said longitudinal axis and along the transverse axis of said resilient block and extending generally laterally outwardly of said block, said rigid contact pins extending across and spanning said central cavity, being secured within said outer lip only and applying a force against said inner lip, said inner lip adjoining said central cavity along a generally convex surface with the surface of each of said rigid contact pins being substantially tangentially arranged relative to said convex surface, and with the surface of said rigid contact pins maintaining said convex surface in flexed disposition away from said central cavity to normally bias said convex surface against the surface of said rigid contact pins.

2. The connector means as defined in claim 1 being particularly characterized in that slots are formed within said member parallel to said transverse axis along said inner throat member and generally midway between mutually adjacent rigid contact pins.

* * * * *